United States Patent [19]

Stevens

[11] Patent Number: 4,735,267

[45] Date of Patent: Apr. 5, 1988

[54] FLEXIBLE PRODUCTION RISER ASSEMBLY AND INSTALLATION METHOD

[75] Inventor: James W. Stevens, Houston, Tex.

[73] Assignee: Shell Oil Company, Houston, Tex.

[21] Appl. No.: 710,657

[22] Filed: Mar. 11, 1985

[51] Int. Cl.[4] ..... E21B 43/013

[52] U.S. Cl. ..... 166/345; 166/346; 166/350; 405/224

[58] Field of Search ..... 166/344–347, 166/366, 367, 350; 405/195, 224; 441/3, 4, 5

[56] References Cited

U.S. PATENT DOCUMENTS

| | | | |
|---|---|---|---|
| 2,701,375 | 2/1955 | Ault | 441/5 |
| 3,426,842 | 2/1969 | Corley, Jr. et al. | 166/344 |
| 3,602,302 | 8/1971 | Kluth | 166/336 |
| 3,677,302 | 7/1972 | Morgan | 441/4 X |
| 3,835,655 | 9/1974 | Oliver | 166/350 X |
| 4,102,142 | 7/1978 | Lee | 405/195 |
| 4,188,156 | 2/1980 | Fisher et al. | 166/367 X |
| 4,240,506 | 12/1980 | Dareing | 166/367 |
| 4,280,430 | 7/1981 | Wilson et al. | 441/3 X |
| 4,400,110 | 8/1983 | Beynet et al. | 405/195 |
| 4,448,568 | 5/1984 | Gentry et al. | 166/345 X |
| 4,462,717 | 7/1984 | Falcimaigne | 166/350 X |
| 4,478,586 | 10/1984 | Gentry et al. | 405/195 X |
| 4,547,163 | 10/1985 | Langpaap et al. | 166/350 X |
| 4,604,961 | 8/1986 | Ortloff et al. | 441/4 X |
| 4,650,431 | 3/1987 | Kentosh | 441/4 X |

*Primary Examiner*—James A. Leppink
*Assistant Examiner*—Matthew Smith

[57] ABSTRACT

In offshore waters an all-steel, flexible marine riser assembly may be used to transport production fluid from a submerged wellhead to a floating production facility.

The marine riser assembly consists of an array of flexible steel flowline bundles which form a cantenary shape as they bend upward from the marine bottom to the production facility.

2 Claims, 5 Drawing Sheets

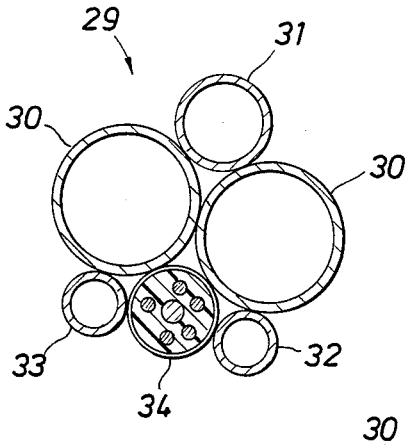
FIG. 2
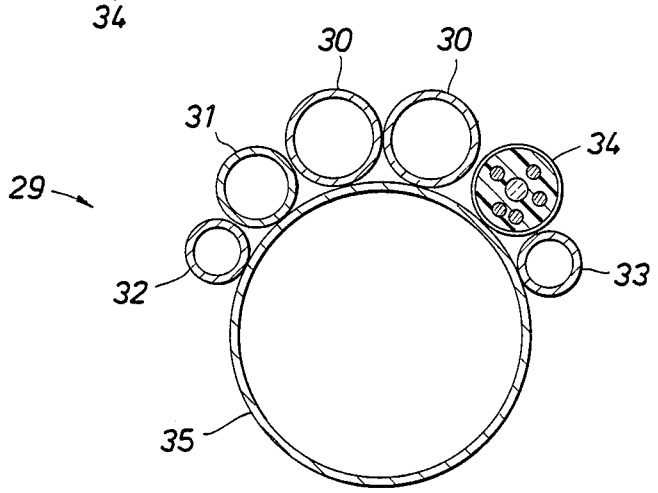
FIG. 3
FIG. 4
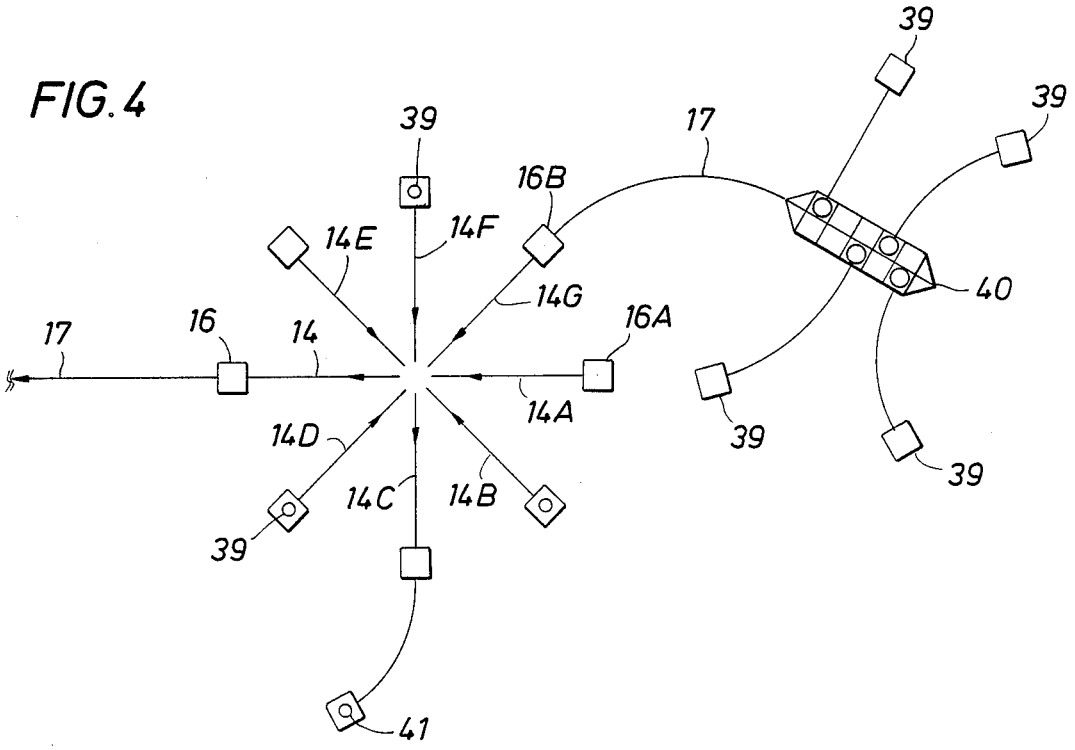

FLEXIBLE PRODUCTION RISER ASSEMBLY AND INSTALLATION METHOD

BACKGROUND OF THE INVENTION

1. Field of the Invention:

The present invention relates to a marine production and/or export riser system and method of installation. In particular, it relates to a method and apparatus for connecting flexible steel flowlines between a flowline end structure located on the ocean floor and an offshore production facility floating upon the surface of a body of water.

2. Description of the Prior Art:

In the production of fluid hydrocarbons from deep-water marine oil and gas deposits, a fluid communication system is required from the marine bottom to the surface after production is established from the deposits. Such a system, commonly called a production riser, usually includes multiple conduits through which various produced fluids are transported to and from the surface, including oil and gas production lines, service and hydraulic control lines and electrical umbilicals.

In offshore production, a floating facility can be used as a production and/or storage platform. Since the facility is constantly exposed to surface and sub-surface conditions, it undergoes a variety of movements. In such a zone of turbulence, heave, roll, pitch, surge, etc., may be caused by surface and near surface conditions. In order for a production riser system to function adequately with such a facility, it must be sufficiently complaint to compensate for such movements over long periods of operation without failure.

One example of such a marine riser is the complaint riser system disclosed in U.S. Pat. No. 3,111,692 issued Nov. 26, 1963, to H. D. Cox, entitled "Floating Production Platform." This complaint riser system includes (1) a lower section which extends from the marine bottom and consists of flexible fluid flowlines which connect to an upper float section, (2) an anchored floating production platform, (3) means carried by the production platform to connect the float section to the platform, and (4) a weight assembly also carried by the platform used to submerge the float a selected distance beneath the surface of the water.

It should be remembered that when the '692 design was originated and patented in 1963, bottom-supported platforms could not be located in waters deeper than 200 feet. Today, however, bottom-supported production platforms may be safely used in water depths exceeding 1,000 feet, due to a better knowledge of anticipated design stresses. This improved design knowledge is the result, for example, of advanced computer-assisted design calculations not possible earlier.

Use of the '692 design in water depths exceeding 1,000 feet would not now be advisable. For example, if the platform is to be secured in 5,000 feet of water each anchor chain would have to be approximately 25,000 feet long, and the cost of an entire array of chains would cost well over one million dollars. Use of the weight to submerge the float would also require an additional 10,000 feet of cable, with the associated cost of the attendant winch and hoisting equipment.

Further problems would also be encountered if currently available flexible flowlines are installed between the float section and the ocean floor. If Coflexip flexible flowlines (French Pat. No. 2,370,219) are used, the cost for a series of these flowline bundles would be prohibitive due to the intricate fabrication required in their construction. The grease layers used between the counterwound layers forming each Colflexip flowline also have a tendency to migrate vertically downward when the flowline is maintained in a vertical position. This grease migration may cause rusting and subsequent destruction of the upper portion of the Coflexip flowline, which would necessitate expensive early replacement of sections of the flowline array.

Accordingly, it is desirable to present a method and apparatus that minimizes or eliminates the cumbersome anchoring system, provides inexpensive flexible flowlines with low maintenance requirements, and also presents a simplicity of design that eliminates unnecessary installation and maintenance expenses. The apparatus should eliminate, for example, many of the elements set forth in U.S. Pat. No. 4,367,055, entitled "Subsea Flowline Connection Yoke Assembly and Installation Method," issued Jan. 4, 1983 to Gentry et al. The complex apparatus in patent '055 includes, for example, a yoke assembly mounted on a submerged buoy section having pivotally-mounted loading gates. The submerged buoy is connected to a rigid riser section which is connected at its lower end to a submerged wellhead. The apparatus of the present invention does not include any of these elements, thereby reducing installation and maintenance costs significantly.

SUMMARY OF THE INVENTION

In a preferred embodiment of the present invention, a flexible production riser assembly is formed from bundles of steel pipe suspended from a riser float under a prescribed amount of tension and allowed to drape to the sea floor in the shape of a catenary. Use of the steel pipe to form the flexible flowlines is possible by refinement of computer aided design calculations that have been developed over the last several years. The steel pipe costs significantly less than a similar installation of Coflexip flexible tubing, is readily available, and has a maintenance life in excess of submerged flexible hoses. Weld fatigue studies of steel pipe that have been recently concluded have given the first indication that steel pipe may be used in marine riser applications, as further set forth in the following detailed description.

The inherent stiffness of the resultant flexible steel flowline array connected to the floating production facility may also be used to reduce or eliminate entirely the regular anchoring system of the platform facility which normally consists of chains, buoys, and cables which depend downwardly from the production facility. In other words at least a portion of the forces required to restrain the offshore platform facility within a certain location may now be transferred directly to the flexible steel flowline array.

A further advantage of using steel pipe is the ease of fabrication, modification, and repair of the entire system as compared to other types of flexible marine riser systems.

An adjustably-buoyant float may also be used to raise and lower the upper ends of the steel flowlines in the water, thereby replacing the cumbersome weight, hoist, and cable system discussed earlier in the '692 design.

It is an object of the present invention to provide a flexible production riser assembly for handling production fluid from oil and gas fields in water-covered areas, capable of fluid communication with an offshore production facility.

It is a further object to present a method of installing such a flexible production riser assembly.

These and other features, objects, and advantages of the present invention will become apparent from the following detailed description, wherein reference is made to the figures in the accompanying drawings.

BRIEF DESCRIPTION OF THE DRAWINGS

FIG. 2 is a schematic view in cross section taken along lines 2—2 of FIG. 1, showing a bundle of flexible steel flowlines.

FIG. 3 is a schematic view in cross section of a bundle of flexible steel flowlines, including a buoyant flowline.

FIG. 4 is a plan view taken along lines 4—4 of FIG. 1 showing a schematic representation of a possible orientation of the flexible steel flowline means, flowlines, and well manifold upon the marine bottom.

DETAILED DESCRIPTION OF THE DRAWINGS

Figure 1:
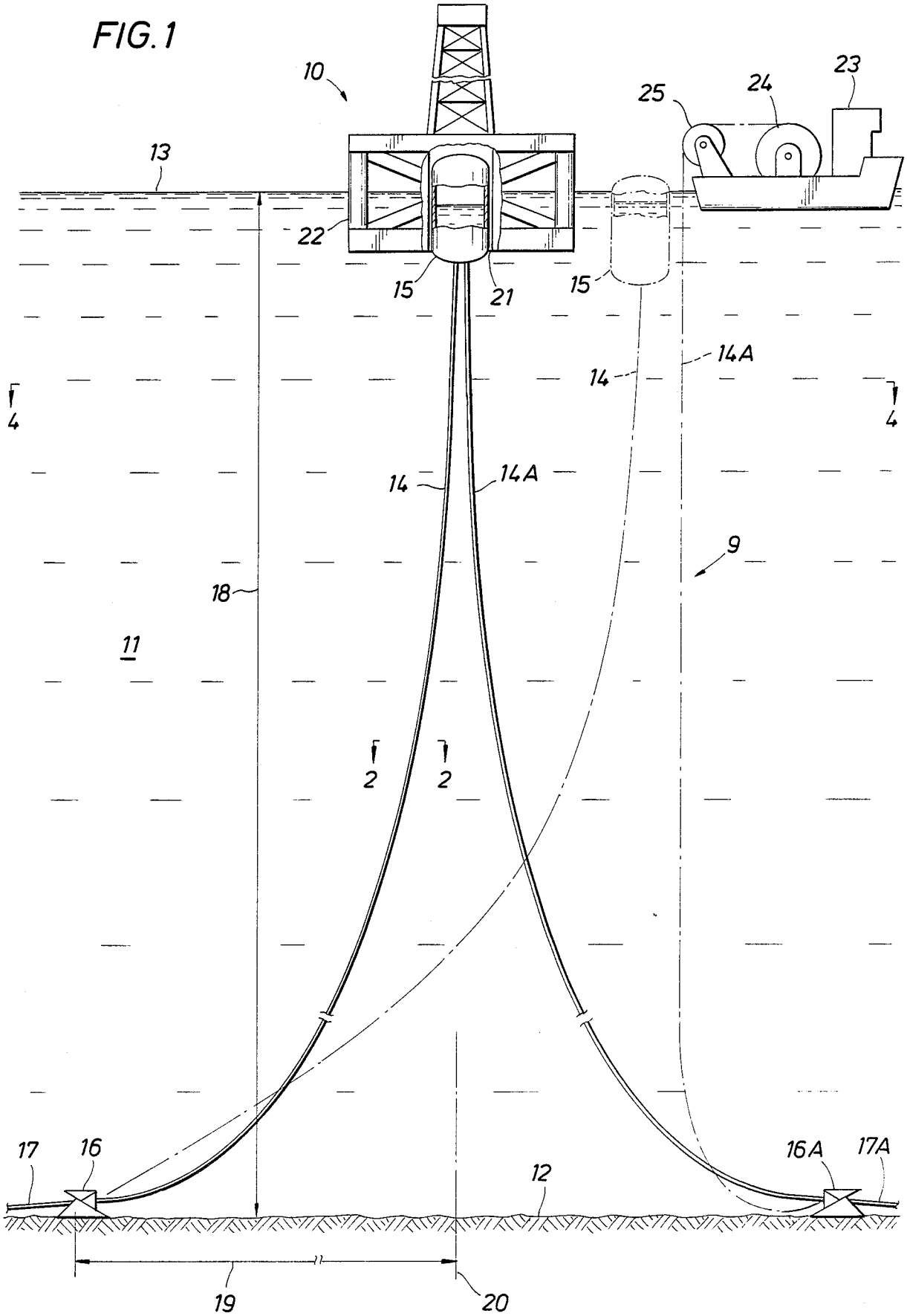
FIG. 1 is a schematic representation of a flexible production riser assembly shown connected at the lower end to the marine bottom and operatively engaged at the upper end to an offshore production facility.

Referring now to FIG. 1, a flexible production riser assembly 9 is shown releaseably secured to an offshore production facility 10. The production facility 10 is shown floating in a body of water 11 having a bottom 12 and a surface 13. Flexible steel flowline means 14, 14A such as bundles of individual steel flowlines carrying production fluids, are shown connected at their upper end to flowline float means 15 and connected at their lower end to flowline end structures 16, 16A, which are also connected to flowlines 17, 17A supported by bottom 12. Flowlines 14, 14A are shown to have a catenary shape during transverse of the distance between float means 15 and flowline end structures 16, 16A.

The flexible steel flowline means 14, 14A have a length at least sufficient to allow connection of the flowline float means 15 to the flowline end structures 16, 16A while said production facility 10 is floating in a body of water 11 having a particular water depth 18, and also with the flowline end structures 16, 16A displaced a lateral distance 19 from the central vertical axis 20 of said flowline float means 15.

The flowline float means 15 is shown positioned within a vertical opening 21 defined upwardly through the offshore production facility 10. The production facility 10 typically has a buoyant hull 22.

Flowline float means 15 is also shown in an alternative position located outside the constraints of the vertical opening 21 of the production facility 10. As shown in the alternative position a flexible steel flowline means 14 has already been operatively engaged to the flowline float means 15 with a subsequent flowline means 14A shown about to be also operatively engaged with the flowline float means 15. Since each flexible steel flowline means 14 may be formed by a bundle of separate steel flowlines capable of storage and subsequent installation from reel winch 24 of vessel 23 over idler sheave 25, it can be readily seen that each flowline means 14, 14A may be easily installed on flowline float means 15.

Referring now to FIG. 2, flexible steel flowlines 29 are shown in a bundle which in a preferred embodiment form one single flexible steel flowline means 14, FIG. 2 being taken along lines 2—2 of FIG. 1. In a preferred embodiment the flexible steel flowlines 29 may consist of a 3 inch 5,000 p.s.i. production line transporting fluid from a subsea flowline end structure 16, a 2 inch 5,000 p.s.i. annulus flowline 31, a 1¼" hydraulic supply line 32 which supplies hydraulic fluid to the operating devices located upon the subsea flowline end structures 16, 16A or any other subsea equipment device, and a 1¼" methanol injection line 33 which may be used to prevent hydrate formation in a subsea well. Control cable 34 may also be included within the flexible steel flowline means 14 to control the operation of devices located upon any wellhead by means well known to the art.

Referring now to FIG. 3, a 6 inch 2,000 p.s.i. buoyancy line 35 may be included within each flexible steel flowline means 14 in order to supply additional buoyancy to each respective steel flowline means 14, 14A. It is recognized that buoyancy line 35 may only extend over a portion of the length of flowline means 14.

Referring now to FIG. 4, which has been taken along lines 4—4 of FIG. 2, an array of flexible steel flowline means 14, 14A–G, is shown in a geometrically spaced arrangement located so as to transport production fluids from well 39, to transport fluids through flowline 17 from manifold 40 by means well known to the art, or to supply injection fluids to injection well 41 by means well known to the art. In a preferred embodiment flexible steel flowline means 14 may also transport fluid from the offshore production facility 10 (FIG. 1) to a flowline 17 which transports production fluids to a shore processing facility (not shown).

Figure 5:
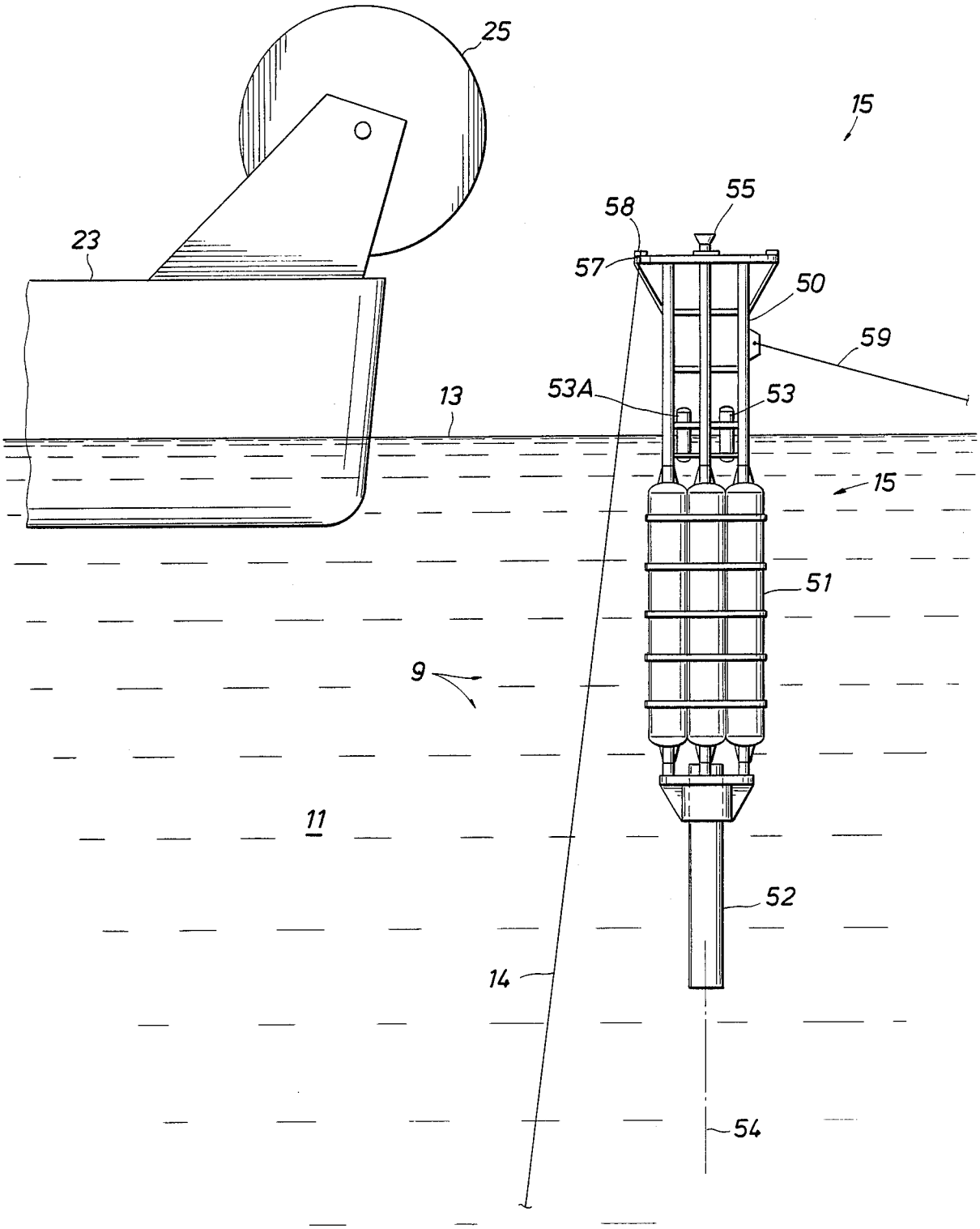
FIG. 5 is a schematic representation showing a flowline float means carrying a flexible steel flowline means and restrained from movement towards a vessel by a temporary restraining cable.

Referring now to FIG. 5, the flowline float means 15 is shown in more detail. An upper support structure 50 formed from steel members is shown located above buoyancy chamber sections 51 which forms buoyancy adjustment means of the flowline float means 15. A ballast leg 52 may form an extendible ballast means. Trim tanks 53, 53A well known to the art are also shown included at the approximate location where the flowline float means 15 passes through the surface of the body of water 11.

A central axis 54 of the float means 15 is shown passing coincidentally through recovery connection 55 located upon the upper portion of the upper support structure 50. The upper end of flowline means 14 is shown operatively engaged to flexible joint means 58, such as a gimble swivel assembly well known to the art. Temporary restraining cable 59 is shown attached to the upper support structure 50 in a location opposite to the original connection point of flowline means 14.

Figure 6:
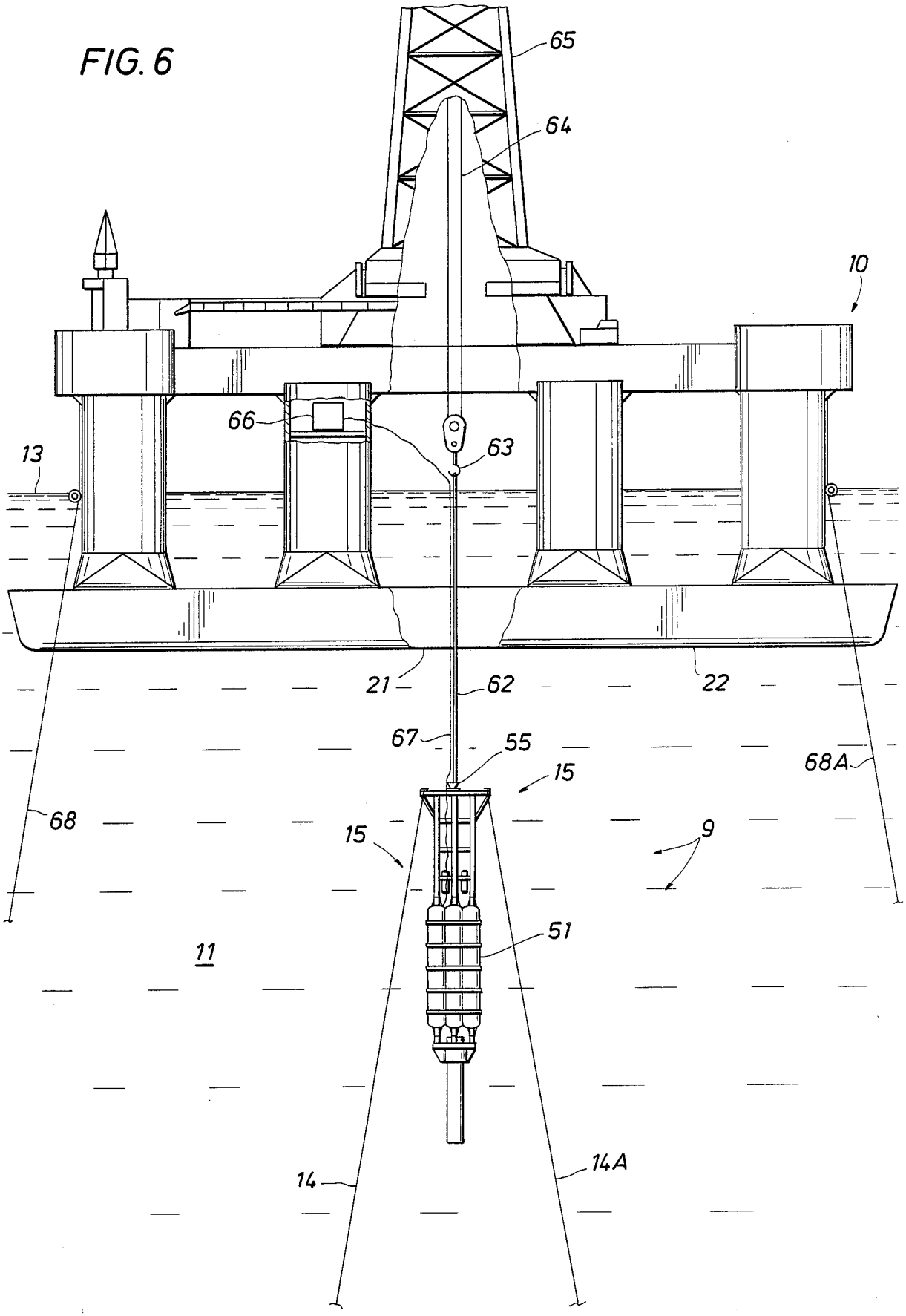
FIG. 6 is a schematic representation showing the flowline float means submerged below an offshore production facility.

Referring now to FIG. 6, the flowline float means 15 are shown submerged below the offshore production facility 10. A recovery pipe 62 is shown connected between hook 63 and recovery connection 55. Riser buoyancy lift means 64 shown attached at their upper end to derrick 65 apply an upwardly-directed force through the hook 63 and recovery pipe 62 to the flowline float means 15. An air compressor 66 well known to the art may supply compressed air through air conduit 67 to adjustable buoyancy means 51. Anchor means 68, 68A are shown secured to opposite ends of the offshore production facility 10. The anchor means 68, 68A may take the form of an array of cables or chains and submerged buoys coupled to a corresponding array of anchors (not shown) located at the bottom 12 of the body of water 11 in a manner well known to the art.

Figure 7:
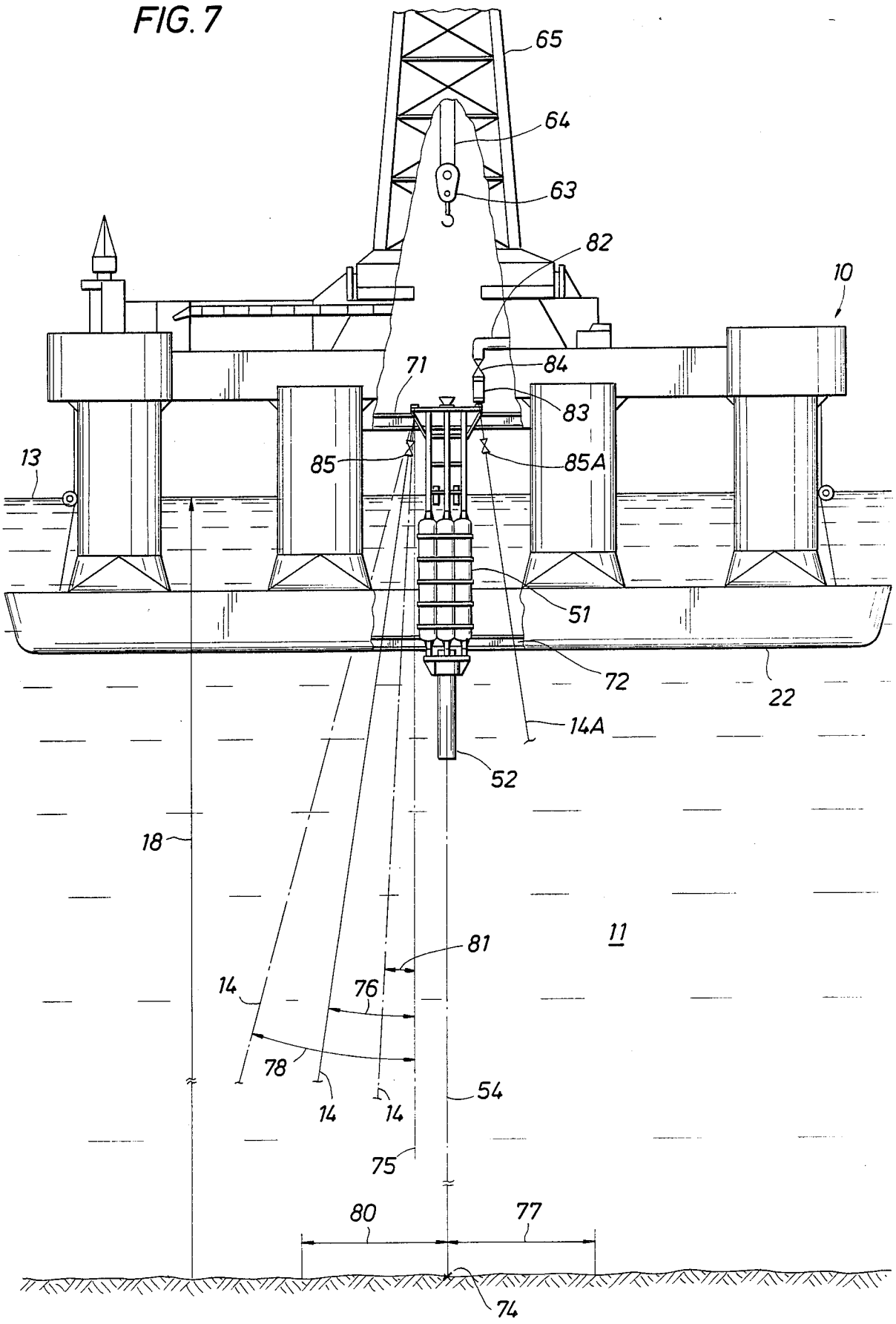
FIG. 7 is a schematic representation showing the flowline float means raised within the offshore production facility and secured in place by connection means, such as two locking beams.

Referring now to FIG. 7, the flowline float means 15 is shown positioned within the offshore production facility 10. Upper locking beam 71 and lower locking beam 72 have operatively secured the flowline float means 15 to the facility 10. The central axis of the flowline float means 15 can be seen to have stabilized over a zero offset position 74 located upon the bottom of the body of water 11. When the float means 15 is in this zero offset position 74, a offset angle 76 is defined between the upper portion of the steel flowline means 14 located adjacent the float means 15 and the flexible joint means vertical axis 75. This offset angle 76 may typically have a value of 9 degrees in a water depth 18 of 3,000 feet. It the central axis 54 moves a positive offset distance 77 away from the zero offset location 74, then a positive offset angle 78 will be defined between the upper portion of the steel flowline means 14 and the flexible joint means vertical axis 75. The value of this positive offset angle 78 may be approximately 20 degrees in a 3,000 foot water depth 18.

Alternatively, if the central axis 54 moves a negative offset distance 80 away from the zero offset location 74, then the relocated position of steel flowline means 14 may define a negative offset angle 81 between the upper portion of the flowline means 14 and the flexible joint means vertical axis 75, typically having a value of 2 degrees in a water depth 18 of approximately 3,000 feet.

In a preferred embodiment, if the facility 10 moves a distance equal to 15% of the water depth 18 away from zero offset location 74, then an offset angle 78, 81 of either 20° or 2°, respectively, may be established between the vertical axis 75 and the upper portion of the steel flowline means 14.

Referring now to the upper portion of FIG. 7, fluid conduit means 82 are shown connected to releaseable pipe connector means 83 through valve 84. The pipe connector means 83 are capable of placing flowline means 14A in fluid communication with the fluid conduit means 82 which form a portion of the processing equipment (not shown) carried by the offshore production facility 10. Isolation valve 85A may prevent flow through the flowline means 14A when the flowline means 14A are not capable of fluid communication with the processing equipment.

Referring more specifically to the above-referenced drawings, it can be seen that the flexible production riser assembly 9 may comprise flowline float means 15, flexible steel flowline means 14, 14A and flexible joint means 58. Flowline float means 15 in a preferred embodiment may be releasably secured to the upper locking beam 71 and lower locking beam 72 which form portions of the connection means mentioned earlier. The flowline float means 15 may be carried in vertical alignment with the hull opening 21. The float means 15 should therefore be of a size to pass upwardly through the opening 21 in the buoyant hull 22 of the offshore production facility 10.

In a preferred embodiment each flexible steel flowline 29 may have a constant cross section along the length of the entire flowline 29. In this manner each flowline 29 may be fabricated from commercially available steel pipe sections.

Dependent upon the structural rigidity of the entire flexible production riser assembly 9, the flexible steel flowline means 14, 14A may effectively anchor the production facility 10 in a position above the flowline end structure 16, 16A. Use of the riser assembly 9 in this manner may act to completely eliminate the anchor means 68, 68A shown in FIG. 6, therefore allowing the offshore production facility 10 to be permanently installed without the use of such anchor means 68, 68A.

It is also recognized that at least one of the flexible steel flowlines 29 in each of the flexible steel flowline means 14, 14A may contain gas (such as pressurized air) supplied from the production facility 10 to increase the overall positive buoyancy of each of the flexible steel flowline means 14, 14A.

Referring to FIG. 1, stress calculations have revealed that in order to reduce the likelihood of kinking of the flexible steel flowline means 14, 14A the distance between the offshore production facility 10 and the bottom 12 of the body of water 11 should be maintained less than the distance between a point on the water bottom 12 located substantially centrally below said flowline float means 15 and the nearest lower end of said flexible steel flowline means 14, 14A. In other words, the horizontal component of the length of each respective flowline means 14 should be greater than the vertical component of the length of each flowline means 14.

In operation, and particularly referring to FIGS. 5, 6 and 7, the float means 15 may be initially off-loaded from a barge (not shown) and thereafter allowed to float in said body of water 11. The ballast leg 52 may be extended downwardly at this time to increase the hydrodynamic stability of the float means 15. A vessel 23 may then be used along with other apparatus (not shown) to operatively engage at least one of the flexible steel flowline means 14, 14A to at least one of the flowline end structures 16, 16A located upon the bottom of the body of water 12.

The flexible steel flowline means 14 may thereafter be bent upwardly towards the flowline float means 15, by applying sufficient tension to the flowline means 14 to cause the entire flowline means 14 to be positioned in a catenary manner between the flowline end structure 16 and the flowline float means 15. At least one flowline means 14 may then be operatively engaged to flexible joint means 58 carried in a preferred embodiment upon the upper support structure 50 of the flowline float means 15. In this manner the flexible flowline means 14 will become secured to the flowline float means 15, yet will still be able to swivel freely relative to a plane defined horizontal to the upper support structure 50.

During the connection of this first flexible steel flowline means 14 to the flowline float means 15 a restraining cable 59 may be connected to the flowline float means 15 opposite the point of connection of the first flexible steel flowline means 14, and thereafter tensioned sufficiently to prevent movement of flowline float means 15 towards the point of attachment of the first flexible steel flowline means 14. It is recognized that cable 59 may be secured to a vessel 23, or to a submerged anchor (not shown) in order to apply a restraining force to float means 15. Alternatively, a plurality of cables 59 may be used with submerged anchors (not shown) to moor float means 15.

If the upper end of the flowline means 14 obtains a vertical orientation, the flowline means 14 may permanently deform at the lower end. For this reason the flowline float means 15 must be used to maintain the proper geometric relationship between the flowline means 14, central axis 54, and flowline end structure 16 so as to maintain at least a 1 to 2 degree vertical offset angle 81 between the upper portion of flowline means 14 and vertical axis 75.

After at least one flexible steel flowline means 14 is connected to the flowline float means 15, the flowline float means 15 may be lowered into the body of water 11 by adding a portion of the body of water 11 to the buoyancy adjusting means such as the buoyancy chamber sections 51 in order to decrease the positive buoyancy of the flowline float means 15 sufficient to cause the entire float means 15 to submerge a selected distance below the surface 13 of the body of water 11. It is understood that subsequent raising of the float means 15 in the body of water 11 through said hull opening 21 of the facility 10 may be accomplished by actuation of the air compressor 66 and subsequent addition of air to the adjustable buoyancy means 51 of the flowline means 15.

Once the flowline float means 15 is submerged a selected distance, the vertical hull opening 21 of the offshore production facility 10 may be positioned substantially centrally over the flowline float means 15, such as by installation and tensioning of anchor means 68, 68A between the offshore production facility 10 and the bottom of said body of water 12. Alternatively, the production facility 10 may also be maintained in position by surface vessel 23 acting upon the facility 10 or alternatively self-contained positioning thrusters (not shown), carried by the hull 22 may be actuated.

The flowline float means 50 may thereafter be raised through the vertical hull opening 21, and thereafter operatively secured to the offshore production facility 10, such as by use of upper locking beams 71 and/or lower locking beams 72. These beams 71, 72, may be swung into position and locked in place either hydraulically and/or by manual means in order to effectively secure the float means 15 to the production facility 10. Recovery pipe 62 may be connected to recovery connection 55 and hook 63 so that the riser buoyancy lift means 64 may apply an upwardly directed force to the flowline float means 15 also.

Once the flowline float means 15 have been secured in place, the flexible steel flowline means 14, 14A may be placed in fluid communication with the fluid conduit means 82 carried by the offshore facility 10. This may be accomplished by placing the flexible steel flowline means 14, 14A in fluid communication with the releaseable pipe connection means 83, which may be disconnected quickly if the flowline float means 15 must be disconnected from the facility 10, such as in the event of an oncoming storm. Valves 85, 85A may also secure the flow of production fluid to or from the subsea well and/or flowlines 17, 17A when the flowline float means 15 is disconnected from the facility 10. It is understood that these valves 84, 85, 85A may be either manually or hydraulically actuated from another control station (not shown) in order to selectively place various flowline means 14, 14A in fluid communication with the fluid conduit means 82, by means well known to the art.

In a preferred embodiment, once flowlines 14, 14A are placed in fluid communication with fluid conduit means 82, the flowline float means 15 may be disconnected from the flowlines 14, 14A (by means not shown) and submerged a selected distance below production facility 10. Flowlines 14, 14A may be supported by upper locking beam 71. The total mass of the facility 10 may be decreased in this manner.

Many other variations and modifications may be made to the apparatus and techniques hereinbefore described, both by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

I claim:

1. A flexible production riser assembly for handling production fluid from oil and gas fields in water-covered areas, capable of fluid communication with an offshore production facility having a buoyant hull adapted to float said production facility on a body of water, said hull having a vertical opening therethrough, said offshore production facility carrying releasable pipe connector means capable of placing fluid conduit means carried by said offshore facility in fluid communication with said flexible production riser assembly, and carrying connection means rigidly secured to said offshore production facility to operatively secure the upper portion of said flexible production riser assembly to said offshore production facility, said flexible production riser assembly comprising;

flowline float means releasably secured to said connection means in vertical alignment with said hull opening, said flowline float means being of a size to pass through said opening in said hull and having buoyancy adjustment means to adjust the position of said flowline float means relative to the surface of said body of water, flexible steel flowline means operatively engaged with said flowline float means, each of said flexible steel flowline means extending downwardly through said body of water in a divergent manner away from each other, each of said flexible steel flowline means thereafter being operatively engaged with flowline end structures separated on the bottom of said body of water from each other, said flexible steel flowline means including at least one flexible steel flowline, said at least one flexible steel flowline operatively engaged with said flowline float means as said flowline float means floats in said body of water a distance away from said offshore production facility, and flexible joint means operatively engaged with the upper ends of said flexible steel flowline means and said flowline float means, to secure said flexible steel flowline means to said flowline float means.

2. A method of handling production fluid from oil and gas fields in water covered areas, using a flexible production riser assembly capable of fluid communication with an offshore production facility having a buoyant hull adapted to float said production facility on a body of water, said hull having a vertical opening therethrough, said offshore production facility carrying releasable pipe connection means capable of placing fluid conduit means carried by said offshore facility in fluid communication with said flexible production riser assembly, and carrying connection means rigidly secured to said offshore production facility to operatively secure the upper portion of said flexible production riser assembly to said offshore production facility, said flexible production riser assembly comprising;

flowline float means releasably secureable to said connection means in vertical alignment with said hull opening said flowline float means being of a size to pass through said opening in said hull and having buoyancy adjustment means to adjust the position of said flowling float means relative to the surface of said body of water, flexible steel flowline means operatively engageable to flowline end structures located on the bottom of said body of water and thereafter bendable upward and operatively engageable to said flowline float means, said flexible steel flowline means including at least one flexible steel flowline, and flexible joint means operatively engageable between the upper ends of said flexible steel flowline means and said flowline float means, to secure said flexible steel flowline means to said flowline float means, said method comprising:

floating a distance away from said offshore production facility said flowline float means in said body of water, operatively engaging at least one of said flexible steel flowline means to at least one of said flowline end structures, thereafter bending in a catenary manner said flexible steel flowline means upwards towards said flowline float means, operatively engaging at least one of said flexible steel flowline means to the upper portion of said flowline float means, as said flowline float means floats in said body of water a distance away from said offshore production facility, the upper portion of said flowline float means positioned above the surface of said body of water, lowering said flowline float means in said body of water, positioning the vertical hull opening of said offshore production facility substantially centrally over said flowline float means, raising said flowline float means in said body of water through said vertical hull opening of said production facility, operatively securing said flowline float means to said offshore production facility, and placing said flexible steel flowline means in fluid communication with said fluid conduit means carried by said offshore facility.

* * * * *